US007479609B1

(12) United States Patent
Kim et al.

(10) Patent No.: US 7,479,609 B1
(45) Date of Patent: Jan. 20, 2009

(54) ADJUSTABLE SNAP ACTION SWITCH

(75) Inventors: Yong C. Kim, Glendale, CA (US); Hein Pekelharing, Bad Neuheim (DE)

(73) Assignee: Barksdale, Inc., Los Angeles, CA (US)

( * ) Notice: Subject to any disclaimer, the term of this patent is extended or adjusted under 35 U.S.C. 154(b) by 1105 days.

(21) Appl. No.: 10/613,199

(22) Filed: Jul. 3, 2003

(51) Int. Cl.
*H01H 35/34* (2006.01)

(52) U.S. Cl. ..... 200/83 P; 200/81 R; 200/81.4; 200/405

(58) Field of Classification Search ..... 200/405–409, 200/81 R, 81.4, 81.5, 83 R, 83 A, 83 B, 83 J, 200/83 P, 83 S, 302.1
See application file for complete search history.

(56) References Cited

U.S. PATENT DOCUMENTS 3,213,228 A * 10/1965 Burch et al. ..... 200/407
4,032,734 A * 6/1977 Burch ..... 200/407
4,920,240 A * 4/1990 Poling ..... 200/83 P
5,001,317 A * 3/1991 Atkinson et al. ..... 200/83 Y
5,149,150 A * 9/1992 Davis ..... 267/159
5,187,338 A * 2/1993 Kaigler ..... 200/83 R
5,555,972 A 9/1996 Schwab
5,790,010 A 8/1998 Schwab
5,950,811 A * 9/1999 Kautz et al. ..... 200/407
6,246,020 B1 * 6/2001 Sato ..... 200/263

* cited by examiner

*Primary Examiner*—Elvin G Enad
*Assistant Examiner*—Marina Fishman
(74) *Attorney, Agent, or Firm*—Leon D. Rosen

(57) ABSTRACT

A snap action switch (12) which includes an M-type actuator having an actuation location that can be depressed to cause a middle contact to snap up against an upper contact, and which can be released to cause the middle contact to snap down against a lower contact, which enables adjustment of the position at which the middle contact snaps against a selected one of the upper and lower contacts. The adjustment of a snap position of the actuation location is accomplished by raising or lowering the position of one of the upper or lower contacts.

5 Claims, 4 Drawing Sheets

ADJUSTABLE SNAP ACTION SWITCH

BACKGROUND OF THE INVENTION

One type of electrical switch includes a bi-stable actuator with a snap contact that initially lies against a stop. When an actuation location on the actuator is depressed beyond a critical height, a snap contact suddenly snaps against a stationary contact. In many cases, the stop is another stationary contact, and the switch is a single-pole double throw type. The actuator is mounted on a frame that holds a movable operator that has an operator and that is moveable against the actuation location of the actuator, to trip the switch.

The actuation location may have to be depressed by a small distance such as five to ten mils (1 mil=1/1000 in) before the critical depression distance is reached and the actuator snaps to snap the middle contact up against the upper contact. When an operator that has depressed the actuation location, begins to move upward again, a second critical height is reached, at which the actuator snaps back, causing the middle contact to snap down against a stop or the stationary contact. It would be desirable if the precise locations of the critical snap heights could be adjusted.

SUMMARY OF THE INVENTION

In accordance with one embodiment of the present invention, a snap action switch is provided, of the type that includes an actuator that holds a middle contact that snaps from a lower stop or a lower contact up against an upper contact when an actuation location is depressed beyond a critical downward actuation height, and that causes the middle contact to snap down again when the actuation location is raised beyond an upward actuation height, which enables adjustment of at least one of the actuation heights. Applicant finds that the upward actuation height at which the middle contact snaps down to its initial position, could be adjusted by adjusting the height of the upper contact.

The upper contact lies on a cantilevered beam with a fixed end and with an opposite end whose height can be adjusted by a screw. This screw adjustment places the adjustment location away from the upper contact and enables finer adjustment of the upper contact height, and therefore of the upward actuation height.

The electrical switch can be part of a detector that has an operator that is spring biased upwardly but that can be depressed, as by a pre-determined fluid pressure, to move down against the actuator to operate the electrical switch. The pressure required to depress the operator sufficiently to throw the switch, can be adjusted by turning a threaded nut to slightly increase or decrease the spring force against the operator. The pressure at which the switch opens, or at least at which the middle contact moves down against the upper contact, is adjusted by adjusting the height of the upper contact.

The novel features of the invention are set forth with particularity in the appended claims. The invention will be best understood from the following description when read in conjunction with the accompanying drawings.

DESCRIPTION OF THE PREFERRED EMBODIMENT

Figure 2:
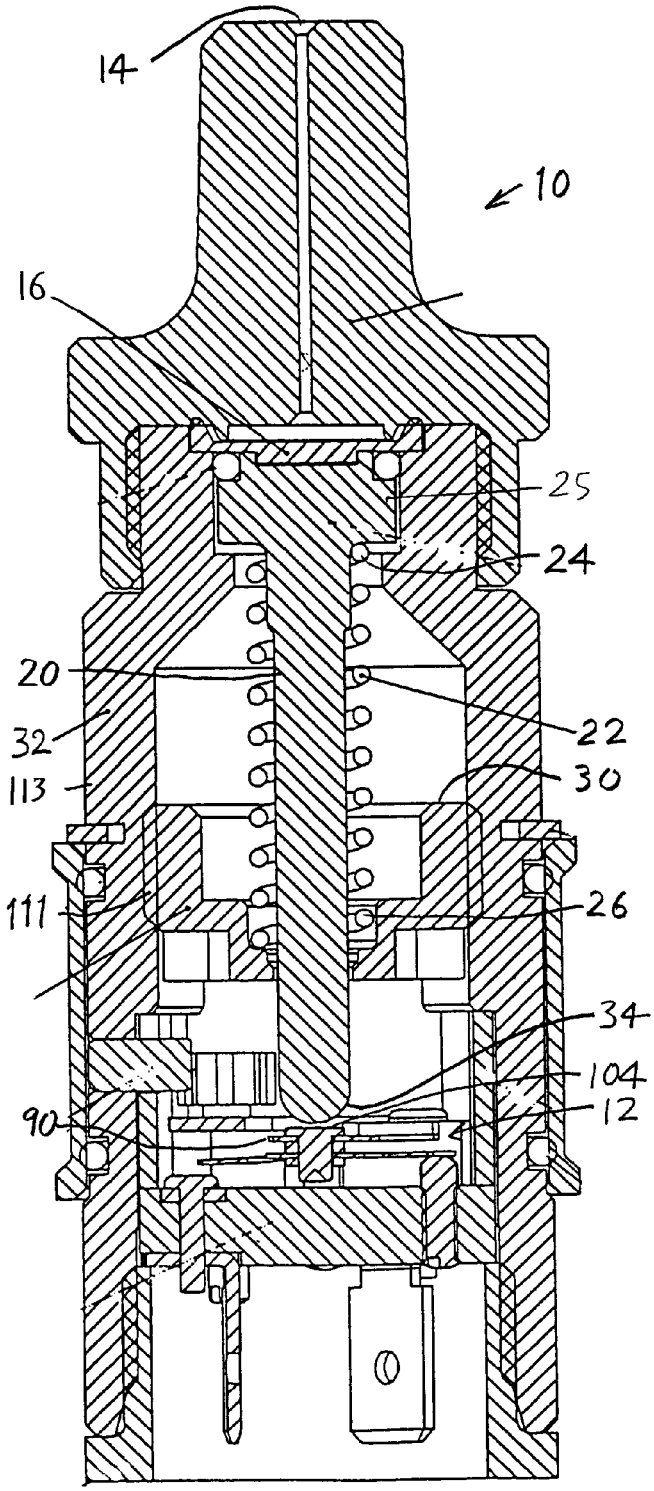
FIG. 2 is a sectional view of the detector of FIG. 1.
Figure 1:
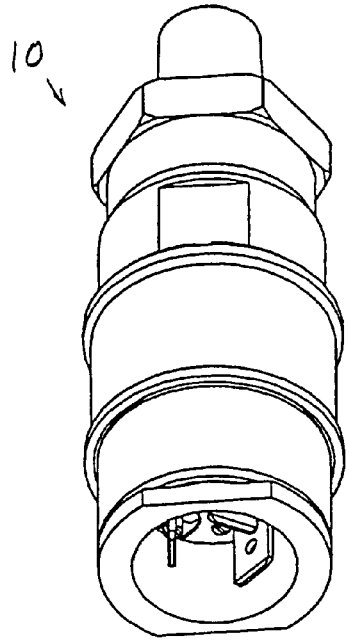
FIG. 1 is a bottom isometric view of a detector that includes the snap action switch of the present invention.

FIG. 2 illustrates a snap action switch arrangement in the form of a fluid pressure detector 10 that includes a snap action switch 12. Fluid under pressure is applied through an opening 14 of the detector, and presses against a membrane 16 to depress an operator 20 that slides in upward U and downward D directions. The operator 20 is biased upwardly by a spring 22 that has a spring upper end 24 that is engaged with a flange 25 of the operator and with a spring lower end 26 that is engaged with an adjustment member in the form of a nut 30 of a frame 32. When the pressure exceeds a pre-determined level (e.g. 100 psi) the operator is depressed sufficiently for an operator tripping end 34 to operate the snap action switch 12.

Figure 5:
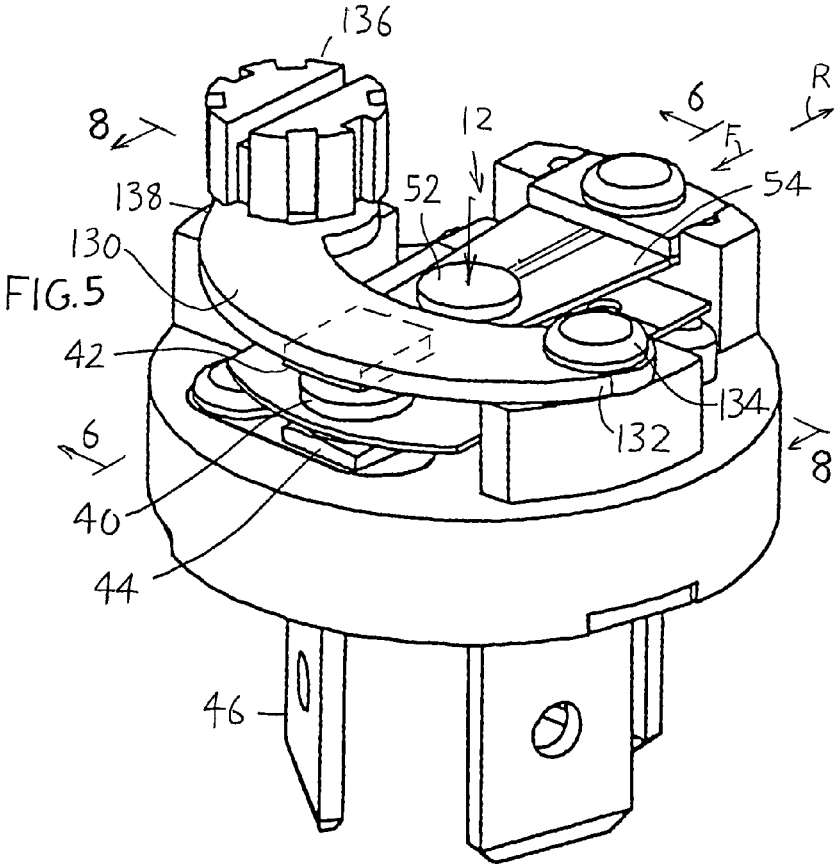
FIG. 5 is a top isometric view of the snap action switch of FIG. 2.
Figure 6:
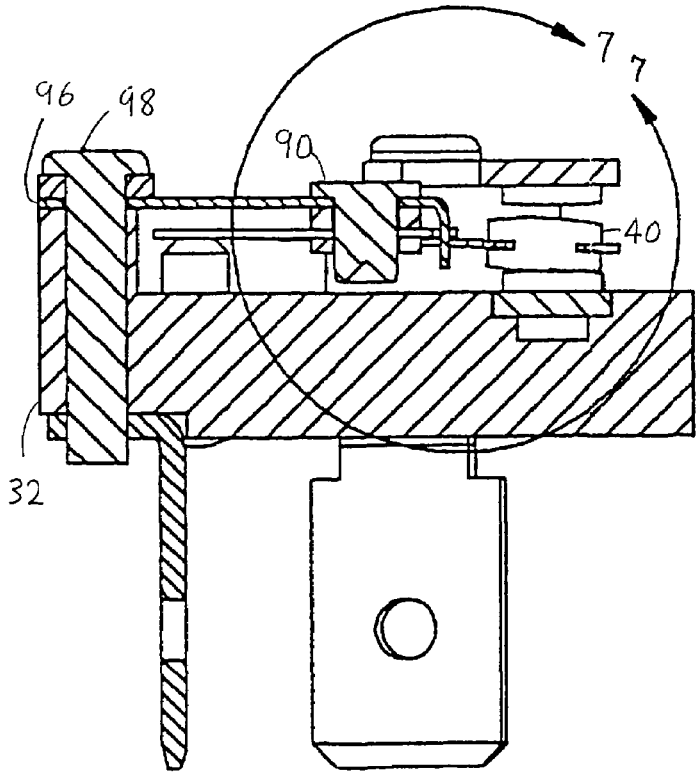
FIG. 6 is a sectional view taken on line 6-6 of FIG. 5.

FIG. 5 shows that the snap action switch 12 includes a middle snap contact 40 and upper and lower unsnap contacts 42 and 44. Applicant uses the term "unsnap" to indicate that the upper and lower contacts are usually stationary throughout repeated operations of the switch. Three electrical terminals 46 are each connected to one of the three contacts 40-44. An actuator 50 which includes a sheet metal blade 54 with a convoluted slot and on which the middle contact 40 is mounted, is constructed to snap the middle contact 40 up and down as an actuation location 52 is moved down below a lower actuation height and released to move up above the upper actuation height. The sheet metal blade 54 is of the M type blade described in U.S. Pat. Nos. 5,555,972 and 5,790,010 by Schwab, which describe an actuator that snaps contacts up and down.

Figure 3:
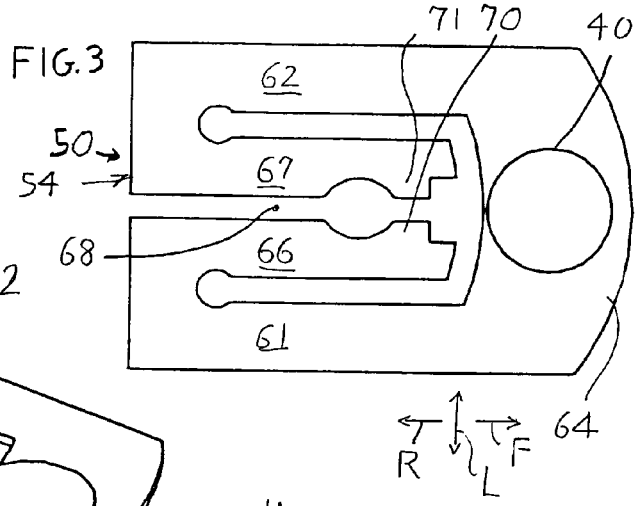
FIG. 3 is a plan view of the actuator member of the switch of FIG. 2.
Figure 4:
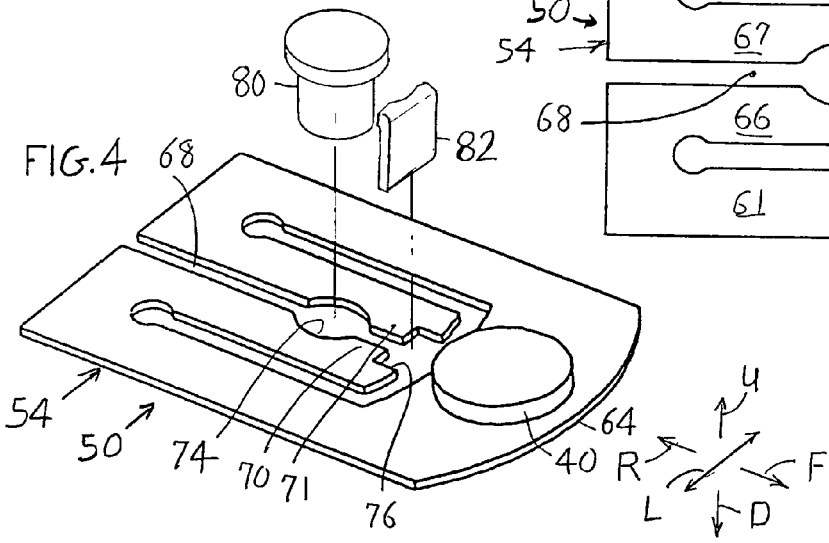
FIG. 4 is a top isometric view of the actuator member of FIG. 3.

FIGS. 3 and 4 show that the sheet metal blade has a slot that forms a pair of laterally L spaced outer legs 61, 62 with front F ends joined by a largely laterally-extending tripping leg 64. The member also has a pair of inner legs 66, 67 that lie between the outer legs, the inner legs being laterally spaced to form a gap 68 between them. The inner legs have rear R ends joined to rear ends of the outer legs. The middle snap contact 40 is mounted on the tripping leg 64 and extends both above and below the tripping leg. In this type of actuator member, when forces are applied to the inner legs 66, 67 that spread them apart, especially at their front portions, the actuation member exhibits a bi-stable state, wherein the tripping leg and middle contact 40 tend to snap up or down. That is, when the front portions 70, 71 of the inner legs are pushed apart and then pushed down, the middle contact 40 snaps up, and when such downward depression of the inner leg front portions 70, 71 is released, the middle contact 40 snaps down to its original position. Thus the front portions 70, 72 may be considered to constitute an actuation location that can be moved up or down to snap the actuator 50.

FIG. 4 shows first and second posts 80, 82 that are used to spread apart the front portions 70, 71 of the inner legs. The first post 80 is in the form of a rivet. The adjacent sides of the inner legs are formed with recesses 74 that receive the rivet, but with the rivet pushing apart the walls of the two recesses. The second post 82 is in the form of a strip that separates a pair of recesses 76 in the front ends of the inner legs at the sides of the inner legs that form the gap 68. The first post 80 preferably creates a majority of the inner leg deflection, while the second post 82 creates slight additional leg separation at locations spaced from the first post, to more precisely separate the inner legs and therefore more precisely control the amount of deflection required to snap the middle contact 40.

Figure 7:
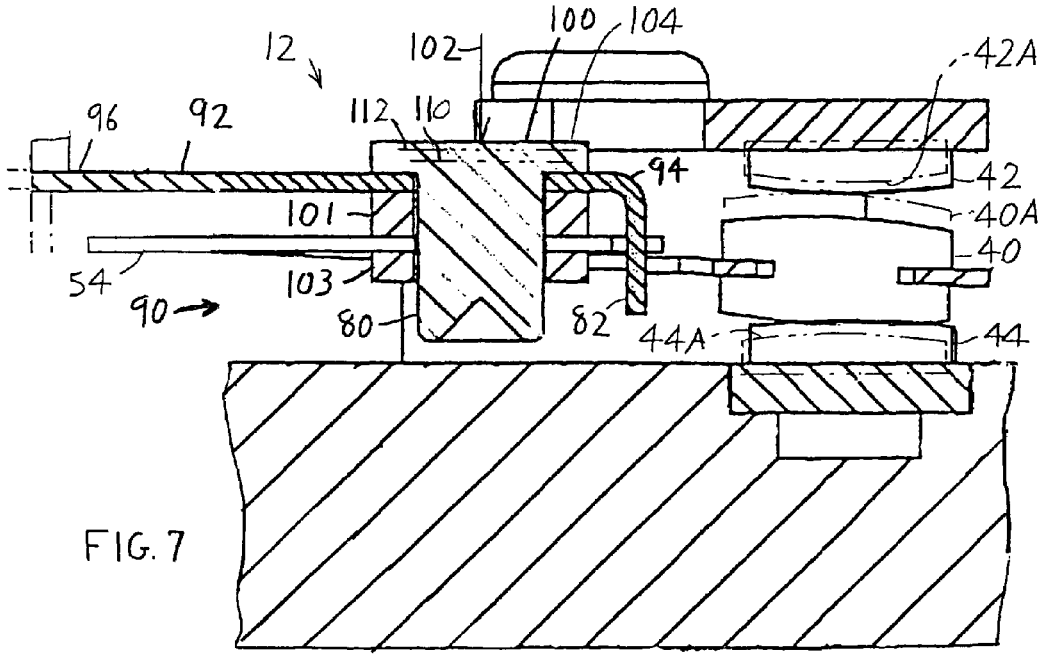
FIG. 7 is an enlarged view of area 7-7 of FIG. 6.

FIG. 7 shows that the posts 80, 82 are part of a loading assembly 90 that receives force arising from operator deflection, and that can apply downward forces to the inner legs, while also spreading apart the inner legs. The loading assembly includes a beam 92 with a front portion forming a right angle bend 94 and a downwardly extending portion that forms the second post 82. The beam has a rear end 96 that is fixed to the frame 32 by a rivet-like fastener 98. The first post 80 is formed by a rivet 100 that is fastened to the beam 92 by a pair of spacers 101, 103, the rivet being in a press fit with the spacer 103.

Downward forces to operate the switch, are applied along arrow 102 to an upper face 104 of the rivet. Accordingly, the upper face of the rivet also can be considered to be an actuation location that can be moved to move blade locations 70, 71 to snap the actuator. Initially, the middle contact 40 lies pressed downward against the lower contact 44. As the upper face 104 of the rivet is depressed, it reaches a lower first snap height 110, at which the actuator switches from its first bistable state wherein the middle contact 40 lies against the lower contact 44, to an upward state wherein the contact at 40A lies against the upper contact 42. This change of state is sudden, so the middle contact can be said to snap upward. When the upper face 104 of the rivet is allowed to rise, it reaches an upper second snap height 112 at which the middle contact at 40A suddenly snaps downward against the lower contact 44. The rivet can move upward an additional amount, to the position shown in solid lines in FIG. 7, wherein the blade 54 is substantially horizontal.

FIG. 2 shows that the operator end 34 initially lies spaced a small distance from the face or surface 104 of the loading assembly 90. The spring 22 is pre-loaded, that is, is initially compressed. Accordingly, it requires a pre-determined fluid pressure to depress the diaphragm 16 far enough that the operator trigger end 34 engages and depresses the rivet face 104 by the small amount required to actuate the switch and cause the middle contact to snap upward. Of course, when the pressure decreases, the operator end 34 moves up sufficiently to allow the middle contact to snap down.

It is desirable to allow slight adjustments of the pressure at which the snap actuator switch 12 is operated to move up the middle contact (to indicate that the pressure has increased to a pre-determined level such as 100 psi) and to adjust the pressure at which the middle contact will snap down against the lower contact (e.g. when the pressure has decreased to below 98 psi). The pressure at which the middle contact snaps up can be adjusted by turning the nut 30 (FIG. 2) which is threadably connected at 111 to a major part 113 of the frame. When the nut 30 is turned to further compress the spring 22, it requires a higher pressure to overcome the initial spring compression to snap the middle contact upward. Turning the nut 30 to reduce spring initial compression and increase initial spring length reduces the required pressure to initially snap the middle contact upward.

The lower pressure to which the fluid can fall (e.g. from 100 psi to 98 psi) at which the middle contact snaps down, can be adjusted. Referring to FIG. 7, applicant has found that if the upper contact 42 is raised slightly as to position 42A, that the upper actuation height 112 at which the middle contact 40 snaps down, is raised slightly. Accordingly, by raising the upper contact to position 42A, applicant has slightly lowered the fluid pressure (e.g. from 98 psi to 97.5 psi) at which the switch is switched (by the middle contact 40 snapping down against the lower contact 44).

Applicant therefore can make fine adjustments to the pressure required to initially trip the switch (wherein the middle contact snaps upward), and the drop in pressure required to untrip the switch (so its middle contact snaps downward). One adjustment is made by varying initial spring pre-load, and the other is made by varying the height of the upper contact. It is also possible to vary the pressure or force required to initially trip the switch to snap the middle contact upward, by varying the height of the lower contact 44, as to position 44A. A lowering of the lower contact 44 results in the lower actuator height 110 moving down slightly.

Figure 8:
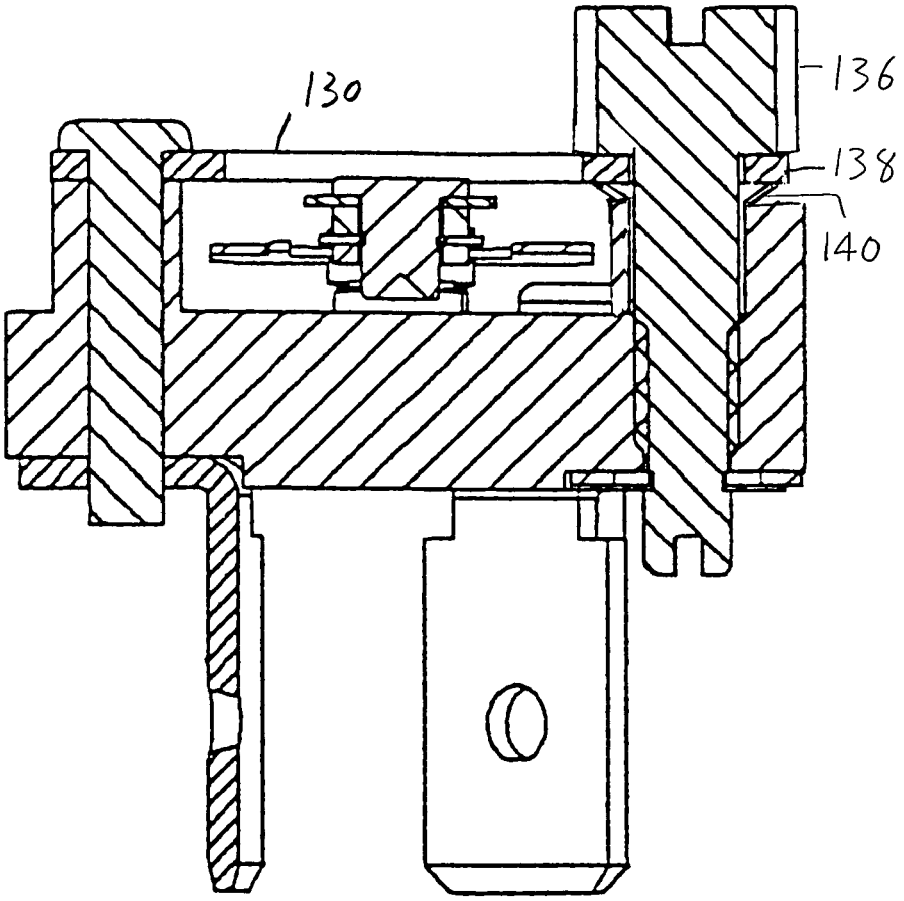
FIG. 8 is a sectional view taken on line 8-8 of FIG. 5.

As shown in FIG. 5, the upper contact 42 is mounted on the middle of a cantilevered beam 130. One end 132 of the beam is fixed in place by a rivet fastener 134. The other end of the cantilevered beam can be moved up and down by turning an adjustment screw 136. When the adjustment screw 136 is turned clockwise (when looking downward at the top of the screw) a far end 138 of the cantilevered beam is moved downward, while when the adjustment screw is moved upward the far end 138 is moved upward. The fact that the upper contact 42 lies about halfway between the ends of the cantilevered beam, results in the upper contact 42 moving up and down only half as much as the cantilevered beam far end 138. This allows fine adjustment of the height of the upper contact 42. FIG. 8 shows details of how rotation of the screw 136 causes up and down movement of the beam far end 138 and consequent vertical movement of the upper contact 42. A spring in the form of a cone washer 140 biases the beam far end upwardly while allowing its downward deflection. An elastic washer or other spring device can be used.

The fluid pressure detector 10 of FIG. 2 can be calibrated by using a test instrument to apply a fluid pressure to the input 14 and increasing the pressure until the snap action switch 12 is found to snap, when the middle contact breaks engagement with the lower contact and engages the upper contact. The nut 30 can be adjusted until the switch triggers at the desired pressure. The lower actuation pressure to snap back the switch (e.g. decreased to 98 psi) is then monitored. If the lower pressure is too high, it can be lowered by slightly moving down the upper contact 42, and vice-versa. While the above description is for a fluid pressure detector, a similar spring-biased operator 20 can be used to measure changes in temperature (e.g. by fluid expansion and contraction) or other quantity that results in movement of an actuator.

In a snap action switch of a construction shown in FIG. 7 wherein the length of the blade 54 is about an inch, depression of the rivet by 5 to 10 mils (one mil equals one-thousandth inch) results in the middle contact snapping upward by a distance of about 10 to 20 mils.

While the drawings illustrate the detector and snap action switch in a particular orientation, and with corresponding terms such as "upper" and "lower" being used to describe the invention as it is illustrated and claimed, it should be understood that the detector and snap action switch can be used in any orientation with respect to the Earth.

Thus, the invention provides a snap action switch of the type that includes an actuator comprising a sheet metal blade of a general type that is known in the art, and a detector that employs this switch, wherein the snap positions of the switch can be finely adjusted. The switch includes a loading assembly that spreads apart inner legs of the actuator at two locations for more precise snapping, including a resilient beam that supports the inner legs of the actuator member, while allowing it to move up and down. The precise upper actuation height can be finely adjusted by moving the upper contact slightly upward or downward. It is also possible to adjust the lower actuation height by moving the lower contact up or down into a new position. The upper contact preferably lies in the middle portion of a cantilevered beam, with a far end of the beam adjusted up or down by the turning of a screw.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A snap action switch which includes upper and lower nonsnap contacts, and which includes a snap action actuator having an actuation location and a tripping leg and a middle snap contact on the tripping leg, said middle contact lying between said upper and lower contacts and said middle contact being moveable between a down position against said lower contact and an up position against said upper contact, said actuator being constructed to snap said middle contact from said down position to said up position when said actuation location is depressed beyond a first snap height and to snap said middle contact from said up position to said down position when said actuation location is allowed to rise beyond a second snap height, comprising:

means for varying the height of one of said nonsnap contacts, to thereby vary one of said snap heights at which said middle contact snaps.

2. A snap action switch comprising:

a frame;

an operator that is moveably mounted in said frame and that has an operator triggering end;

a spring that is mounted in said frame and that has a frame-abutting end coupled to said frame and an operator-abutting end coupled to said operator and urging said operator end upwardly;

upper and lower unsnap contacts mounted on said frame;

a snap action actuator having an actuation location lying immediately below said operator end, to be moved downward by said operator end, said actuator having a trigger leg with a middle snap contact thereon lying between said upper and lower contacts and moveable between a down position against said lower contact and an up position against said upper contact, said actuator constructed to snap said middle contact from said down position to said up position when said actuation location is moved down beyond a first snap height, and to snap said middle contact from said up position to said down position when said actuation location rises beyond a second snap height, comprising:

means for adjusting the position of said upper contact to position said upper contact at higher and lower positions relative to said lower contact, to thereby change the height at which said middle contact snaps down.

3. The switch described in claim 2 wherein:

said means for adjusting includes a beam with a first beam location fixed to said frame, a second beam location that is spaced from said first locations with said upper contact being fixed to said beam at said beam second location, and a beam third location that is spaced from said beam first location, said means for fixing also including a screw that can be tightened to press down said beam third location.

4. The switch described in claim 2 wherein:

said frame has a fluid inlet, and including a membrane with a periphery fixed to said frame, and with a first membrane side exposed to said fluid and an opposite membrane side that applies force to said operator to urge said operator downwardly against said spring force;

said snap action actuator snaps said middle contact down against said lower contact when said operator moves upward beyond an upper actuation height (112), and said means for adjusting adjusts the height of the said upper contact to adjust said upper actuation height.

5. A method for use with a snap action switch arrangement which includes a frame, an operator that is moveably mounted in the frame, a spring coupled to the operator and frame and biasing the operator in a downward direction, upper and lower unsnap contacts mounted on said frame, and a snap action actuator having an actuation location lying immediately below said operator to be moved downward by said operator, said actuator having a trigger leg with a middle snap contact thereon lying between said upper and lower unsnap contacts and moveable between a down position against said lower contact and an up position against said upper contact, said actuator constructed to snap said middle contact from said down position to said up position when said actuation location is moved down beyond a first snap height, and to snap said middle contact from said up position to said down position when said actuation location rises beyond a second snap height, the method being useful to adjust said second snap height at which said middle contact snaps to said down position, comprising:

adjusting the height of said upper unsnap contact relative to said snap action actuator.

* * * * *